US009786972B2

(12) United States Patent
Kawamura et al.

(10) Patent No.: US 9,786,972 B2
(45) Date of Patent: Oct. 10, 2017

(54) MILLIMETER WAVEBAND FILTER

(71) Applicant: ANRITSU CORPORATION, Kanagawa (JP)

(72) Inventors: Takashi Kawamura, Kanagawa (JP); Akihito Otani, Kanagawa (JP)

(73) Assignee: Anritsu Corporation, Kanagawa (JP)

( * ) Notice: Subject to any disclaimer, the term of this patent is extended or adjusted under 35 U.S.C. 154(b) by 70 days.

(21) Appl. No.: 14/790,086

(22) Filed: Jul. 2, 2015

(65) Prior Publication Data

US 2016/0020499 A1 Jan. 21, 2016

(30) Foreign Application Priority Data

Jul. 18, 2014 (JP) ..... 2014-148060

(51) Int. Cl.

| | |
|---|---|
| ***H01P 1/201*** | (2006.01) |
| ***H01P 1/207*** | (2006.01) |
| ***H01P 1/04*** | (2006.01) |
| ***H01P 5/02*** | (2006.01) |

(52) U.S. Cl.

CPC ..... *H01P 1/201* (2013.01); *H01P 1/042* (2013.01); *H01P 1/207* (2013.01); *H01P 5/024* (2013.01)

(58) Field of Classification Search

CPC ..... H01P 1/201; H01P 1/207; H01P 1/212; H01P 3/12; H01P 5/04; H01P 1/042; H01P 5/024; F16L 23/00; F16L 23/02; F16L 23/04; F16L 23/06

USPC ..... 333/24 R, 208, 209, 211, 212, 248, 254, 333/255, 256, 260

See application file for complete search history.

(56) References Cited

U.S. PATENT DOCUMENTS

2013/0314179 A1* 11/2013 Kawamura ..... H01P 1/201 333/208

FOREIGN PATENT DOCUMENTS

| | | |
|---|---|---|
| JP | 2013138401 A | 7/2013 |
| JP | 2013247381 A | 12/2013 |

* cited by examiner

*Primary Examiner* — Robert Pascal
*Assistant Examiner* — Jorge Salazar, Jr.
(74) *Attorney, Agent, or Firm* — Pearne & Gordon LLP

(57) ABSTRACT

In an end surface 32*b* of the second transmission line forming body 32 forming a second waveguide 30, the height of a central region 33 which includes an opening of the second transmission line 30*b* is a reference plane. A depressed portion 32*e* that is depressed to a depth greater than the length of a thread portion of a screw 205 from the reference plane is provided in a region outside the central region 33 and includes a screw hole forming position. A screw hole 32*d* for fixing an external circuit 200 to be connected is provided at the screw hole forming position in the depressed portion 32*e*. The height of a region, which is excluding the depressed portion 32*e* and is further away from the central region 33 than the screw hole forming position, is equal to the reference plane.

10 Claims, 16 Drawing Sheets

MILLIMETER WAVEBAND FILTER

TECHNICAL FIELD

The present invention relates to a millimeter waveband filter.

BACKGROUND ART

In recent years, with the advent of a ubiquitous network society, there have been increasing needs for using radio waves and a wireless personal area network (WPAN) for achieving a home wireless broadband network (wireless personal area network) or a millimeter-wave wireless system, such as a millimeter-wave radar, for supporting stable and safe operation has started to be used. In addition, measures for a 100-GHz ultra-wide band wireless system have been actively taken.

However, in the evaluation of the second-order harmonics of a wireless system with a bandwidth of 60 GHz to 70 GHz or the evaluation of wireless signals in a frequency band greater than 100 GHz, as the frequency increases, the noise level of a measuring device and the conversion loss of a mixer increase and frequency accuracy is reduced. Therefore, a technique for measuring wireless signals in a frequency band greater than 100 GHz with high sensitivity and high accuracy has not been established. In addition, it is difficult for the measuring technique according to the related art to separate harmonics of a local oscillating signal from the measurement result and to accurately measure, for example, unnecessary radiation.

In order to solve these technical problems and measure wireless signals in a frequency band greater than 100 GHz with high sensitivity and high accuracy, it is necessary to develop a narrow bandpass filter technique such as a millimeter waveband filter technique for suppressing an image response and a high-order harmonic response. In particular, a filter technique which can be applied to a variable frequency (tunable) type is preferable.

The inventors have proposed a millimeter waveband filter in which a Fabry-Perot resonator used in the optical field is applied to millimeter waves and which selectively transmits desired frequency components of millimeter waves using the resonance between a pair of radio wave half mirrors that are provided in a transmission line of a waveguide structure, which transmits the electromagnetic waves in a TE10 mode (single mode), so as to be opposite to each other (Patent Document Patent Document 1 discloses a technique in which a transmission line that transmits electromagnetic waves in a desired frequency band in the TE10 mode is formed by a first waveguide and a second waveguide into which one end of the first waveguide is inserted with a slight gap therebetween and is fixed such that the radio wave half mirrors faces each other at the leading end of the first waveguide and in the second waveguide, and one of the waveguides is moved in the longitudinal direction relative to the other waveguide such that the gap between the radio wave half mirrors is changed.

According to the millimeter waveband filter with the above-mentioned structure, characteristics do not deteriorate due to wave front conversion and it is possible to improve flexibility in the design of the radio wave half mirrors. In addition, loss caused by spatial radiation is less and the gap between the pair of radio wave half mirrors can be changed to change the resonance frequency of the filter.

However, when the millimeter waveband filter with the above-mentioned structure is actually manufactured, it is necessary to provide a gap which enables the waveguides to move in the longitudinal direction relative to each other between the outer circumferential wall of the first inner waveguide and the inner circumferential wall of the second outer waveguide. The gap is continuous with the space of the resonator formed between the pair of radio wave half mirrors and electromagnetic waves which reciprocate between the radio wave half mirrors leak to the outside through the gap. As a result, the characteristics of the filter deteriorate.

Therefore, it is necessary to minimize the gap. For example, in the case of a waveguide including a transmission line with a size of about 2 mm×1 mm, the allowed gap is equal to or less than several tens of micrometers (for example, 20 μm to 30 μm), which are dimensions that can be observed only by a microscope. However, as in the millimeter waveband filter having the above-mentioned structure, in the structure in which the leading end of the first waveguide is inserted into the second transmission line, it is difficult to observe the gap from the outside and to check a variation in the gap. As a result, it is very difficult to position the waveguides.

As a technique for solving the above-mentioned problems, the inventors have proposed the following technique in Patent Document 2. In the technique, a second outer waveguide includes a first transmission line forming body and a second transmission line forming body. In the first transmission line forming body, a rectangular hole forming a first transmission line with a size which is capable of accommodating one end of a first inner waveguide is formed in a plate portion with a constant thickness to a thickness direction so as to pass through the plate portion. In the second transmission line forming body, a rectangular hole forming a second transmission line having the same size as the first waveguide is formed in a plate portion with a constant thickness in the thickness direction so as to pass through the plate portion. The plate portions of the first transmission line forming body and the second transmission line forming body can be connected to or separated from each other, with the rectangular holes overlapping each other so as to be concentrically continuous.

When this technique is used, it is possible to observe the gap between the outer circumference of the first inner waveguide and the rectangular hole forming the first transmission line in the second outer waveguide from the first transmission line forming body and to accurately position the first and second waveguides. After the positioning process, when the second transmission line forming body is connected to the first transmission line forming body at a predetermined position, the second transmission line is not inclined with respect to the first transmission line and it is possible to accurately position three transmission lines including the transmission line of the first waveguide. Therefore, it is possible to maintain high filter characteristics.

RELATED ART DOCUMENT

Patent Document

[Patent Document 1] Japanese Unexamined Patent Application Publication No. 2013-138401

[Patent Document 2] Japanese Unexamined Patent Application Publication No. 2013-247381

DISCLOSURE OF THE INVENTION

Problem that the Invention is to Solve

However, it was found that the millimeter waveband filter with the structure disclosed in Patent Document 2 had new problems to be solved.

That is, when various types of devices are manufactured using the millimeter waveband filter with the above-mentioned structure, various circuits (external circuits) are generally connected to both ends of the millimeter waveband filter.

The structure of both ends of the millimeter waveband filter needs to be connected to the existing circuits and a standard for the connection has been determined.

For example, when a circuit with a waveguide structure is connected to another circuit, a flange structure based on a MIL standard is generally used.

FIGS. 12(*a*) and 12(*b*) show an example of the flange structure based on the MIL standard. In the example, a first protruding portion 12 which has a cylindrical shape and has a diameter D and a thickness H is provided on one surface 11*a* (a connection surface to another circuit) of a flange portion 11 with a diameter C so as to protrude concentrically. A second protruding portion 13 which has a cylindrical shape and has a diameter E is provided on an opposite surface 11*b* so as to protrude concentrically. A transmission line 14 which has a width A and a height B is formed at the centers of the flange portion 11 and the two protruding portions 12 and 13 so as to pass therethrough. The thickness of the flange portion 11 is represented by J-H and the thickness of the second protruding portion 13 is represented by G-J. Screw holes 16 are provided in the flange portion 11 at positions that are a distance F/2 away from the center of the transmission line 14 and are on a center line which extends in the width direction of the transmission line 14 and a center line which extends in the height direction of the transmission line 14.

In the MIL standard, the dimensions C to H are defined to values which are predetermined according to the width A and the height B of the transmission line.

Therefore, when the connection between the millimeter waveband filter and other circuits with the standard flange structure is considered, the structure of the ends of the waveguides provided at both ends of the millimeter waveband filter needs to correspond to the flange structure.

FIG. 13 shows an example of the structure of a practical millimeter waveband filter considering the above.

In a millimeter waveband filter 20, a transmission line which transmits electromagnetic waves in a desired frequency range of the millimeter-wave band in the TE10 mode is formed by a first waveguide 21 and a second waveguide 30 into which one end 21*a* of the first waveguide 21 is inserted with a slight gap therebetween. The transmission line is fixed such that radio wave half mirrors 50A and 50B faces each other at the tip of the one end 21*a* of the first waveguide 21 and in the second waveguide 30.

As disclosed in Patent Document 2, the second waveguide 30 includes a first transmission line forming body 31 forming a first transmission line 30*a* with a size capable of accommodating the one end 21*a* of the first waveguide 21, with a gap therebetween, and a second transmission line forming body 32 forming a second transmission line 30*b* with a size less than that of the first transmission line 30*a*. The first and second transmission line forming bodies are connected, with the transmission lines being concentrically continuous with each other. The radio wave half mirror 50B is fixed to a boundary portion between the first transmission line 30*a* and the second transmission line 30*b*.

The first transmission line forming body 31 of the second waveguide 30 is fixed to a base portion 60. The first waveguide 21 is supported such that it can be moved in the length direction of the transmission line 22 by a moving device 70 provided in the base portion 60. When the first waveguide 21 is moved, the gap between the radio wave half mirrors 50A and 50B is changed and it is possible to selectively transmit frequency components around a resonance frequency which is determined by the gap.

Protruding portions 21*g* and 32*g* which have a radius determined by the standard from the center of an opening of the transmission line and protrude to a predetermined height are provided in a flange portion 21*b* at the other end of the first waveguide 21 and the second transmission line forming body 32 of the second waveguide 30, respectively. In addition, screw holes 21*d* and 32*d* are provided at prescribed pitches at positions that are away from the center of the opening by a predetermined radius corresponding to the standard.

As such, when the shape of the ends of the two waveguides 21 and 30 corresponds to the flange standard corresponding to the size of the transmission line, it is possible to fix various types of external circuits 200 and 300 based on the same standard with screws 205 and 305, as represented by a one-dot chain line in FIG. 13. As a result, it is possible to easily connect the external circuits.

However, as described above, when the flange portion 21*b* of the first waveguide 21 and the second transmission line forming body 32 of the second waveguide 30 have the flange structure corresponding to the standard and other circuits having the same flange structure are fixed to the flange portion 21*b* and the second transmission line forming body 32 by screws, the outer edge of the second transmission line forming body 32 and a flange portion 200*b* of the external circuit 200 which face each other with a gap therebetween are deformed by the tightening force of the screws 205 in a direction in which they are close to each other, with the protruding portion 32*g* of the second transmission line forming body 32 coming into contact with the end surface of a protruding portion 200*a* of the external circuit 200, as shown in FIG. 14.

The deformation of the outer edge causes a central portion of the second transmission line forming body 32 of the second waveguide 30 to be deformed (curved) in the opposite direction.

The deformation of the central portion of the second transmission line forming body 32 is directly applied to the radio wave half mirror 50B fixed in the vicinity of the central portion in the direction in which the radio wave half mirror 50B is close to the radio wave half mirror 50A. As a result, the distance between the mirrors is reduced and the resonance frequency is changed to increase, which causes a serious problem.

FIG. 15 shows the check result of the relationship between the degree of change in the resonance frequency and the tightening force of screws when circuits having a prescribed flange portion are screwed to the input and output sides of the millimeter waveband filter with the above-mentioned structure by a strong tightening force and a weak tightening force.

As can be seen from FIG. 15, when a tightening force was strong, the resonance frequency which was set in the vicinity of 122.3 GHz when a tightening force was weak was increased by 0.5 GHz or more.

Therefore, in a single filter, even when the characteristics of the resonance frequency with respect to the position of the first waveguide 21 are measured in advance and the frequency of the filter is controlled on the basis of the characteristics, the characteristics of the filter vary depending on the connection state (screwed state) of the external circuit to the filter, which makes it difficult to accurately control the frequency of the filter.

In addition, the flange portion 21*b* of the first waveguide 21 to which the external circuit 300 is screwed is also deformed. However, since the deformation position is separated from the position of the radio wave half mirror 50A, a change of the position of the radio wave half mirror 50A is negligible. In addition, in the first waveguide 21, the flange portion 21*b* provided at the other end can be omitted and the external circuit can be connected through a fixed waveguide which is symmetrical to the second waveguide 30. Therefore, the structure of the first waveguide 21 does not cause any problem.

The deformation of the second transmission line forming body 32 is caused by the structure in which two circuits are screwed to each other, with the protruding portions of the flange portions coming into contact with each other, such that the transmission lines of the two circuits are connected, without a gap therebetween, on the basis of the MIL standard. However, in various types of circuits available in the market, the position of screw holes with respect to the position of a transmission line is based on the MIL standard. However, there is a circuit having a flat flange structure without a protruding portion.

Therefore, when the flat flange structure without a protruding portion is used in the millimeter waveband filter, it is possible to suppress the deformation of the second transmission line forming body 32 due to the tightening of the screws.

However, as shown in FIG. 16, when the second transmission line forming body 32 of the millimeter waveband filter and the external circuit 200 are screwed to each other using the flat flange structure, the continuity between a thread groove of a screw hole 200*c* in the flange portion 200*b* of the external circuit 200 and a thread groove of the screw hole 32*d* in the second transmission line forming body 32 is not guaranteed.

Therefore, in a case in which the screw 205 is inserted into the screw hole 200*c*, with the second transmission line forming body 32 and the external circuit 200 coming into contact with each other, as shown in FIG. 16, when a thread portion 205*c* at the leading end of a shaft portion 205*b* of the screw 205 reaches the boundary between the screw hole 200*c* and the screw hole 32*d* as shown in FIG. 17, the screw hole 200*c* and the screw hole 32*d* are likely to be discontinuous and it is difficult to tighten the screw 205 any further (reference numeral 200*d* indicates a transmission line of the external circuit). Here, four screws are needed in order to connect the external circuit 200 on the basis of the standard. The probability that all of the screw holes have continuity, with the second transmission line forming body and the external circuit coming into contact with each other, is very low. Therefore, it is difficult to connect the second transmission line forming body and the external circuit so as to make these come into contact with each other using the above-mentioned method.

The invention has been made in order to solve the above-mentioned problems and an object of the invention is to provide a millimeter waveband filter which has a flat flange structure and can be easily connected to an external circuit.

Means for Solving the Problem

In order to achieve the object, according to a first aspect of the invention, there is provided a millimeter waveband filter including: a first waveguide including a transmission line with a size that is capable of transmitting electromagnetic waves in a predetermined frequency range of a millimeter waveband in a TE10 mode; a second waveguide that includes a first transmission line which has a diameter that is greater than an outside diameter of the first waveguide and is capable of transmitting the electromagnetic waves in the predetermined frequency range in the TE10 mode and into which one end of the first waveguide is inserted, with a gap between the outside of the first waveguide and the first transmission line, and a second transmission line which has a size less than that of the first transmission line and is formed such that the first transmission line and the second transmission line are concentrically continuous; a pair of radio wave half mirrors that transmit some of the electromagnetic waves in the predetermined frequency range and reflect some of the electromagnetic waves, one of the pair of radio wave half mirrors being fixed to the transmission line at the one end of the first waveguide, the other radio wave half mirror being fixed to a boundary between the first transmission line and the second transmission line of the second waveguide; and a moving device that moves the first waveguide in a length direction of the transmission line such that a gap between the pair of radio wave half mirrors is changed, thereby selectively transmitting an electromagnetic wave with a resonance frequency which is determined by the gap between the pair of radio wave half mirrors among the electromagnetic waves in the predetermined frequency range. The second waveguide includes: a first transmission line forming body in which a rectangular hole forming the first transmission line is formed in a plate portion with a predetermined thickness to a thickness direction so as to pass through the plate portion; and a second transmission line forming body in which a rectangular hole forming the second transmission line is formed in a plate portion with a predetermined thickness in a thickness direction so as to pass through the plate portion. The first transmission line forming body and the second transmission line forming body are formed so as to be connected to and separated from each other, with the plate portions overlapping each other such that the rectangular holes are concentrically continuous. In one end surface of the second transmission line forming body which is opposite to the other surface connected to the first transmission line forming body, a reference plane is at the height of a central region that includes an opening of the second transmission line and a depressed portion that is depressed from the reference plane is provided in a region which is outside the central region and includes a screw hole forming position, and a screw hole into which a screw for fixing an external circuit to be connected is inserted is provided at the screw hole forming position in the depressed portion. The depressed portion has a depth greater than the length of a thread portion of the screw. The height of a region that is excluding the depressed portion and is further away from the central region than the screw hole forming position is equal to the reference plane.

According to a second aspect of the invention, in the millimeter waveband filter according to the first aspect, the first transmission line forming body may be fixed to the base portion. The second transmission line forming body may be fixed to the first transmission line forming body at a predetermined position and may be screwed to a base portion at a position that is further away from the opening of the second transmission line than the screw hole forming position.

According to a third aspect of the invention, in the millimeter waveband filter according to the first aspect, the central region may have the same size as a protruding portion that is defined by a flange structure based on a predetermined standard depending on the size of the second transmission line. The screw hole forming position may be defined by the flange structure. The length of the thread portion may be defined by the flange structure.

According to a fourth aspect of the invention, in the millimeter waveband filter according to the second aspect, the central region may have the same size as a protruding portion that is defined by a flange structure based on a predetermined standard with respect to the diameter of the second transmission line. The screw hole forming position may be defined by the flange structure. The length of the thread portion may be defined by the flange structure.

According to a fifth aspect of the invention, in the millimeter waveband filter according to the third aspect, the second transmission line may have a rectangular shape in a cross-sectional view. Four screw holes which are defined by the flange structure of the second waveguide may be formed. The four screw holes may be formed at positions that are a predetermined distance away from the center of the second transmission line and are arranged on a center line extending in a width direction of the transmission line and a center line extending in a height direction of the transmission line.

According to a sixth aspect of the invention, in the millimeter waveband filter according to the fourth aspect, the second transmission line may have a rectangular shape in a cross-sectional view. Four screw holes which are defined by the flange structure of the second waveguide may be formed. The four screw holes may be formed at positions that are a predetermined distance away from the center of the second transmission line and are sited on a center line extending to a width direction of the transmission line and on a center line extending to a height direction of the transmission line.

According to a seventh aspect of the invention, in the millimeter waveband filter according to the fifth aspect, the length of the shaft portion of the screw may be greater than the thickness of a flange portion of the external circuit. The depth of the depressed portion may be greater than the length of a thread portion having a thread groove formed therein in the screw. The sum of the depth of the depressed portion and the thickness of the flange portion of the external circuit may be less than the sum of the lengths of the shaft portion and the thread portion of the screw.

According to an eighth aspect of the invention, in the millimeter waveband filter according to the sixth aspect, the length of the shaft portion of the screw may be greater than the thickness of a flange portion of the external circuit. The depth of the depressed portion may be greater than the length of a thread portion having a thread groove formed therein in the screw. The sum of the depth of the depressed portion and the thickness of the flange portion of the external circuit may be less than the sum of the lengths of the shaft portion and the thread portion of the screw.

According to a ninth aspect of the invention, in the millimeter waveband filter according to the seventh aspect, the predetermined standard is a MIL standard.

According to a tenth aspect of the invention, in the millimeter waveband filter according to the eighth aspect, the predetermined standard is a MIL standard.

Advantage of the Invention

According to the above-mentioned structure, when the external circuit having a flat connection surface based on a prescribed flange structure is screwed to the second transmission line forming body, at least the central region which forms the reference plane of the end surface of the second transmission line forming body and the region which is arranged outside the screw hole forming position come into close contact with the flat connection surface of the external circuit and the screw hole for connecting the external circuit is provided at a position that is deeper than the thread portion of the screw from the close contact surface. Therefore, it is possible to tighten a plurality of screws, regardless of the continuity between the screw hole in the external circuit and the thread groove of the screw hole in the second transmission line forming body. As a result, it is possible to screw the external circuit while suppressing the deformation of the second transmission line forming body.

According to the above-mentioned aspects of the invention, the first transmission line forming body is fixed to the base portion and the second transmission line forming body is fixed to the first transmission line forming body at a predetermined position and is screwed to the base portion at the position that is further away from the opening of the second transmission line than the screw hole forming position. Therefore, it is possible to further suppress the deformation of the second transmission line forming body when the external circuit is screwed.

BRIEF DESCRIPTION OF THE DRAWINGS

FIG. 14 is a diagram of the related art illustrating the transmission of force when the external circuit is connected to.

BEST MODE FOR CARRYING OUT THE INVENTION

Hereinafter, an embodiment of the invention will be described with reference to the drawings. In the following description, a flange structure is based on a MIL standard, specifically, MIL-F-3922/67B.

Figure 1:
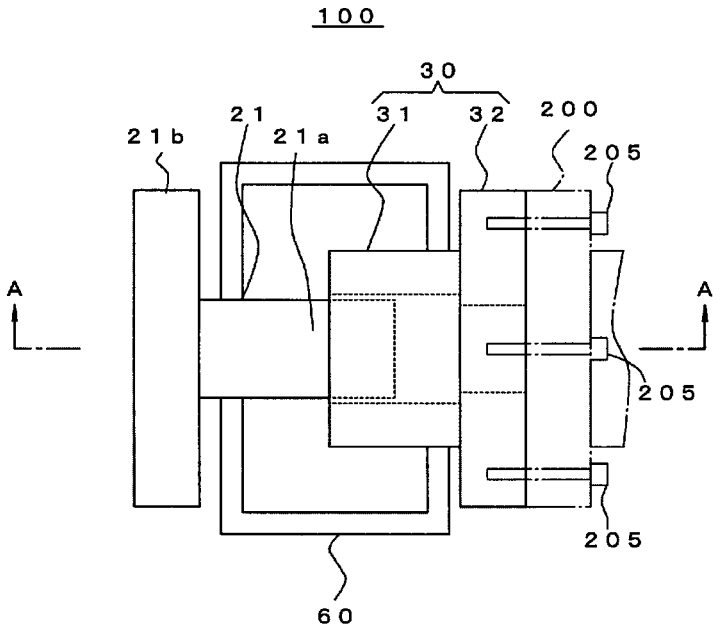
FIG. 1 is a plan view illustrating an embodiment of the invention.
Figure 2:
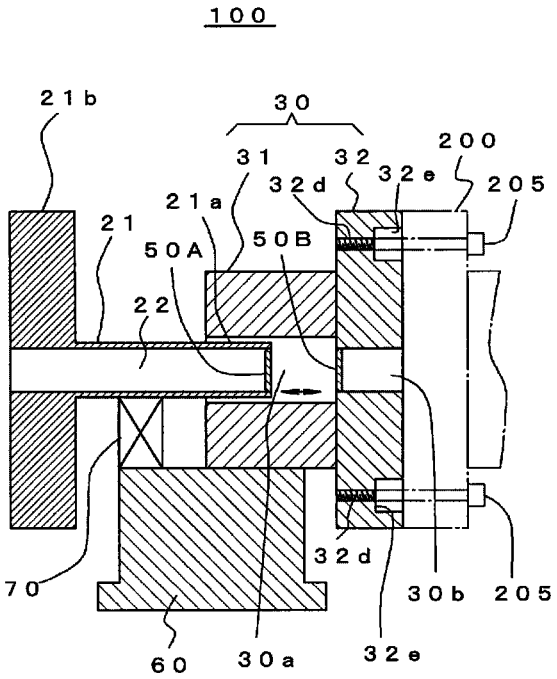
FIG. 2 is a cross-sectional view taken along the line A-A of FIG. 1.
Figure 3:
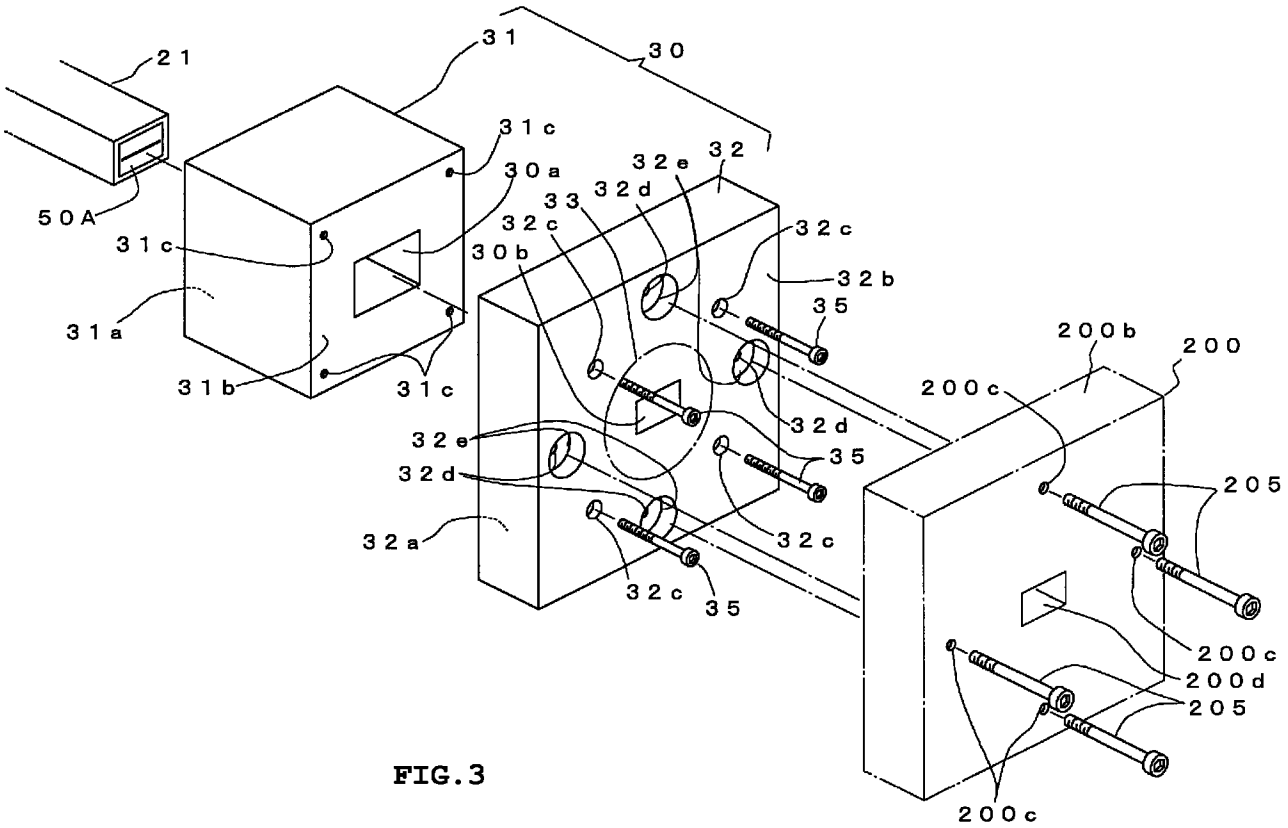
FIG. 3 is an exploded view illustrating a main portion of the embodiment of the invention.

FIG. 1 is a plan view illustrating a millimeter waveband filter 100 according to the invention, FIG. 2 is a cross-sectional view taken along the line A-A of FIG. 1, and FIG. 3 is an exploded view illustrating a main portion.

In FIGS. 1 to 3, the millimeter waveband filter 100 includes a first waveguide 21, a second waveguide 30, radio wave half mirrors 50A and 50B, a base portion 60, and a moving device 70.

The first waveguide 21 includes a transmission line 22 which has a size of about 2 mm×1 mm and transmits electromagnetic waves in a predetermined frequency range (for example, 110 GHz to 140 GHz) of a millimeter-wave band in a TE10 mode. One end 21*a* of the first waveguide 21 is inserted into the second waveguide 30 and a flange portion 21*b* with a large width is formed at the other end of the first waveguide 21. The other end of the first waveguide 21 can have the following structures: the above-mentioned structure in which a prescribed protruding portion is provided in a flange structure based on a predetermined standard and an external circuit is screwed to the flange structure; a structure in which a flange structure is not provided at one end, similarly to the one end 21*a*, the one end is inserted into a fixed waveguide that is symmetrical to the second waveguide 30, which will be described below, and an external circuit is connected to a flange portion of the fixed waveguide; and various other structures. Therefore, the shape of the other end of the first waveguide 21 will not be described in detail in this embodiment.

The second waveguide 30 has a size that is larger than the outside size of the first waveguide 21 and is capable of transmitting electromagnetic waves in a predetermined frequency range in the TE10 mode, and is formed such that a first transmission line 30*a* into which the one end 21*a* (the right end in the drawings) of the first waveguide 21 is inserted, with a gap between the first transmission line and the outside of the first waveguide, and a second transmission line 30*b* having a size less than that of the first transmission line 30*a* (here, the second transmission line 30*b* has the same size as the first waveguide 21) are concentrically continuous.

A first transmission line forming body 31 and a second transmission line forming body 32 overlap each other to form the second waveguide 30. The second waveguide 30 is positioned such that a slight gap (several tens of micrometers) between the outside of the first waveguide 21 and the second waveguide 30 is uniform.

That is, as shown in FIG. 3, in the first transmission line forming body 31, a rectangular hole forming the first transmission line 30*a* is formed in a plate portion with a predetermined thickness so as to pass through the plate portion to a thickness direction (from one surface 31*a* to a surface 31*b* opposite to the one surface 31*a*). In the second transmission line forming body 32, a rectangular hole forming the second transmission line 30*b* is formed in a plate portion with a predetermined thickness so as to pass through the plate portion to a thickness direction (from one surface 32*a* to a surface 32*b* opposite to the one surface 32*a*). The two transmission line forming bodies are connected to each other, with the plate portions overlapping each other such that the rectangular holes are concentrically continuous. Here, connection screw holes 31*c* are provided at four corners of the opposite surface 31*b* of the first transmission line forming body 31. In the second transmission line forming body 32, holes 32*c* for connection screws 35 are provided at positions corresponding to the screw holes 31*c*. The screws 35 inserted into the holes 32*c* are tightened to connect the two transmission line forming bodies, with the transmission lines being concentrically continuous. The head of the screw 35 is inserted into the middle of the hole 32*c* so as not to protrude from the surface.

Since the second waveguide 30 can be connected and separated in this way, the second waveguide 30 is positioned with respect to the first waveguide 21 such that the gap between the outside of the first waveguide 21 and the inside of the first transmission line 30*a* is uniform, while being observed by, for example, a microscope from the opposite surface 31*b* of the first transmission line forming body 31 at the beginning. Then, the second transmission line forming body 32 which is formed in advance so as to be concentrically connected to the first transmission line forming body 31 is screwed to the first transmission line forming body 31. In this way, the positioning between the first waveguide 21 and the second waveguide 30 is completed.

The radio wave half mirror 50A is fixed to one end of the first waveguide 21 so as to close the transmission line 22. The radio wave half mirror 50B is fixed so as to close a boundary portion between the first transmission line 30*a* and the second transmission line 30*b* of the second waveguide 30, practically, the leading end of the second transmission line 30*b* of the second transmission line forming body 32.

The radio wave half mirrors 50A and 50B have a structure in which a slit for transmitting some of electromagnetic waves is provided in a metal substrate that reflects electromagnetic waves. The resonance of a frequency that is determined by the gap between the two radio wave half mirrors 50A and 50B occurs between the radio wave half mirrors 50A and 50B and the operation of a Fabry-Perot filter is obtained.

The first waveguide 21 can be moved in the length direction of the transmission line 20 by the moving device 70 provided in the base portion 60. In this way, a variable-frequency filter with a variable resonance frequency is formed.

An end surface (the above-mentioned opposite surface) 32*b* opposite to the surface of the second transmission line forming body 32 to which the first transmission line forming body 31 is connected has a structure that can be screwed to an external circuit 200 with a flat connection surface while coming into close contact with the external circuit 200.

That is, in the end surface, a reference plane is at the height of a central region 33 which includes an opening of the second transmission line 30*b* and has the same size as the protruding portion that is defined by the flange structure based on the predetermined standard with respect to the size of the second transmission line 30*b*. A depressed portion 32*e* that is depressed to a depth greater than the length of a thread portion of a screw 205 used in the flange structure from the reference plane is provided in a region which is sited outside the central region 33 and includes a screw hole forming position defined by the flange structure. A screw hole 32*d* for screwing the external circuit 200 is provided at the screw hole forming position in the depressed portion 32*e*.

The height of a region, which is excluding the depressed portion 32*e* and is further away from the central region 33 than the screw hole forming position, is equal to the reference plane.

In this example, in the end surface 32*b* of the second transmission line forming body 32, the depressed portion 32*e* is limited to a narrow region surrounding the position where the screw hole 32*d* is formed and the height of the other region including the central region 33 is equal to the reference plane. However, the range of the depressed portion 32*e* may expand to the outer edge of the central region 33 and the depressed portion 32*e* may have any outward shape.

Next, an operation when the external circuit 200 having a flange structure with a flat connection surface is connected to the second transmission line forming body 32 having the above-mentioned end surface structure will be described.

Figure 4:
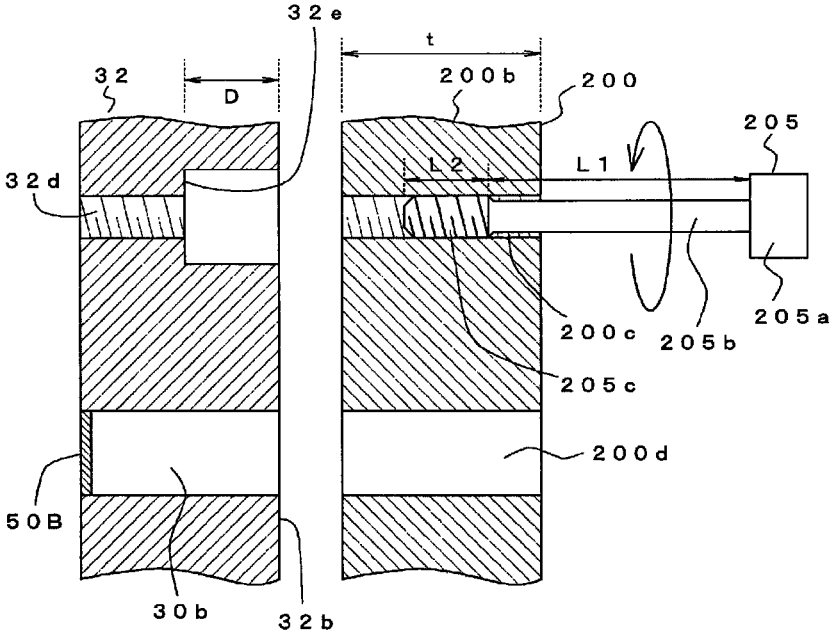
FIG. 4 is a diagram illustrating an operation of connecting an external circuit to a filter according to the embodiment of the invention.

First, as shown in FIG. 4, the prescribed screw 205 is inserted into a screw hole 200*c* with a thread groove which is provided in a flange portion 200*b* of the external circuit 200. Here, the screw 205 includes a head 205*a*, a shaft portion 205*b*, and a thread portion 205*c*. According to the above-mentioned standard, the length L1 of the shaft portion 205*b* is greater than the thickness t of the flange portion 200*b*. In addition, the depth D of the depressed portion 32*e* is slightly greater than the length L2 of the thread portion 205*c* having the thread groove provided therein and the sum t+D of the depth D of the depressed portion 32*e* and the thickness t of the flange portion 200*b* is set to be less than the sum L1+L2 of the length of the shaft portion 205*b* and the length of the thread portion 205*c*. A preferred condition for inserting the entire thread portion 205*c* into the screw hole 32*d* of the second transmission line forming body 32 is that the sum of the depth D of the depressed portion 32*e* and the thickness t of the flange portion 200*b* is equal to the length L1 of the shaft portion 205*b*. In FIG. 4, reference numeral 200*d* is a transmission line of the external circuit 200.

Figure 5:
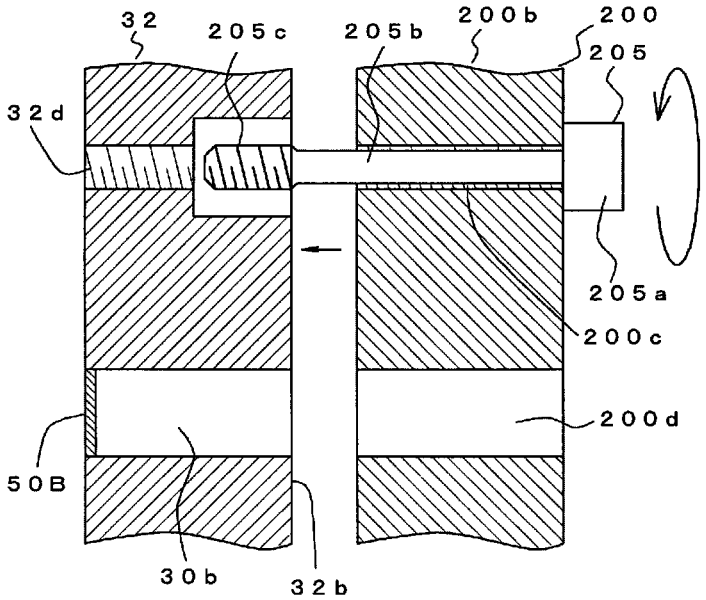
FIG. 5 is a diagram illustrating the operation of connecting the external circuit to the filter according to the embodiment of the invention.

When the screw 205 is tightened on the basis of this condition, the thread portion 205*c* passes through the screw hole 200*c* and the screw 205 is not taken off the flange portion 200*b* and can turn freely, as shown in FIG. 5.

Figure 6:
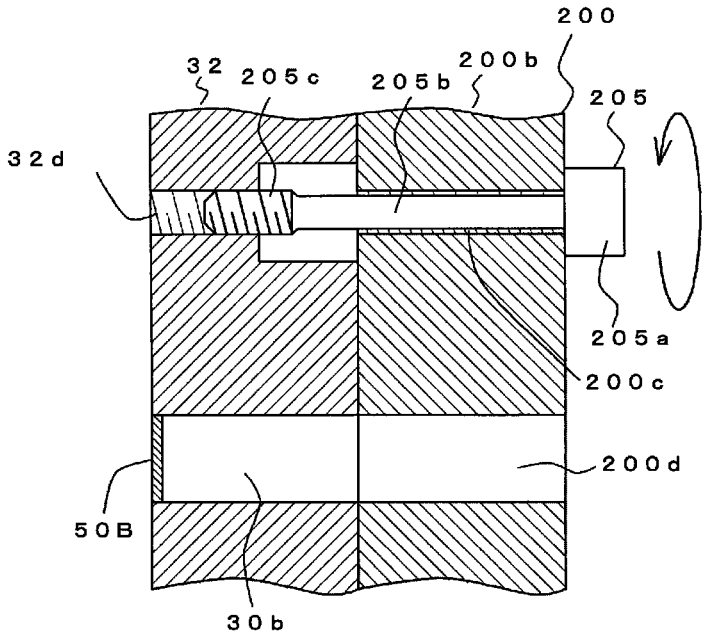
FIG. 6 is a diagram illustrating the operation of connecting the external circuit to the filter according to the embodiment of the invention.

In this state, the external circuit 200 is placed close to the second transmission line forming body 32 and the leading end of the thread portion 205*c* is inserted into the screw hole 32*d* through the depressed portion 32*e* and is then tightened. Then, the flange portion 200*b* is close to the second transmission line forming body 32. Finally, as shown in FIG. 6, the flange portion 200*b* and the second transmission line forming body 32 come into close contact with each other and the screw 205 is tightened.

Figure 7:
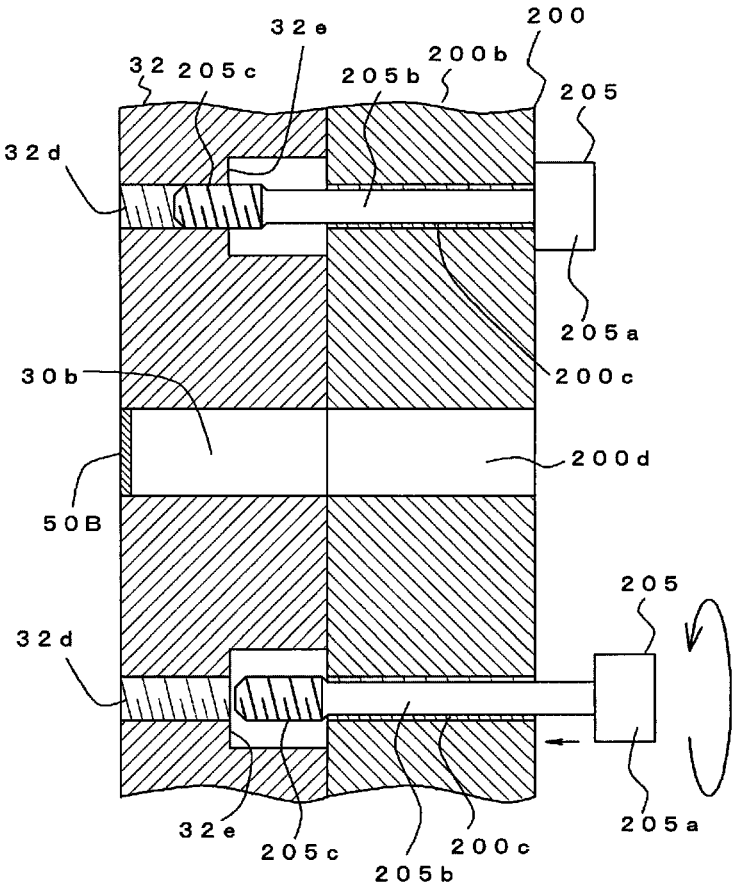
FIG. 7 is a diagram illustrating the operation of connecting the external circuit to the filter according to the embodiment of the invention.
Figure 8:
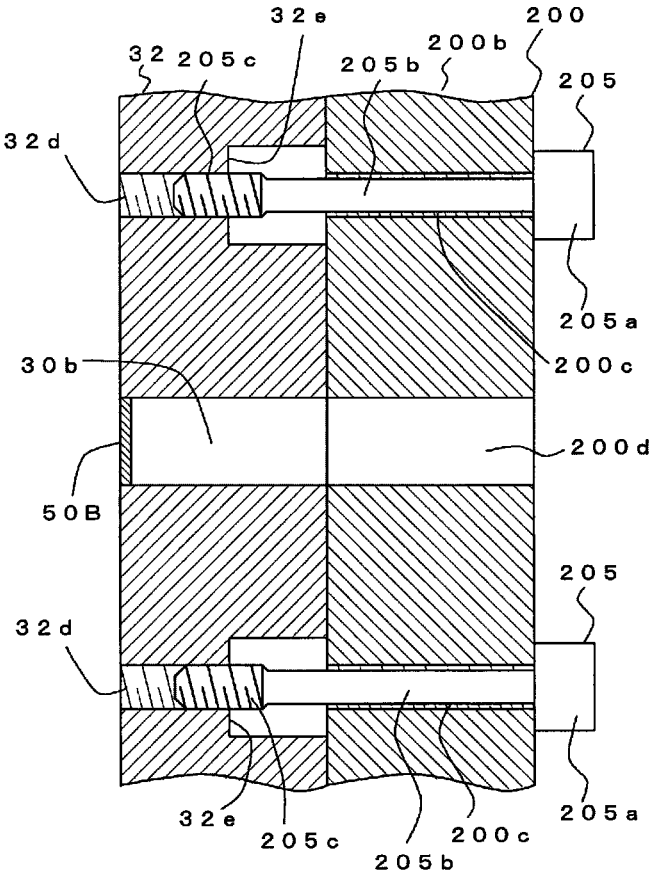
FIG. 8 is a diagram illustrating the operation of connecting the external circuit to the filter according to the embodiment of the invention.

FIG. 7 shows the insertion of another screw 205 into the flange portion 200*b* in the above-mentioned state. In this state, the screw 205 can turn freely, similarly to the above. When the leading end of the screw 205 is inserted into the screw hole 32*d* of the second transmission line forming body 32 and is then turned, the thread portion 205*c* is threadably engaged with the screw hole 32*d*, regardless of continuity between the screw hole 200*c* of the flange portion 200*b* and the thread groove of the screw hole 32*d* of the second transmission line forming body 32. As a result, the screw 205 is tightened as shown in FIG. 8.

When the same operation as described above is performed on the other screws, the tightening of four screws around the transmission line ends. In the end surface 32*b* of the second transmission line forming body 32, a region including the central region 33 which includes at least the opening of the transmission line excluding the depressed portion 32*e* and has a height equal to the reference plane and a region outside the screw hole forming position is connected to the flat connection surface of the external circuit 200 while coming into close contact with the flat connection surface.

As such, the second transmission line forming body 32 is screwed to the external circuit while the central region 33 which is arranged inside the screwing position and the region which is away from the screwing position come into close contact with the external circuit. Therefore, a force to curve an outer circumferential portion of the second transmission line forming body 32 is not generated and a change in the position of the radio wave half mirror 50B is suppressed.

Therefore, when control data indicating the relationship between the resonance frequency and the position of the first waveguide 21 relative to the second waveguide 30 is calculated in advance, accurate variable frequency control is performed on the basis of the control data even in the state in which the external circuit is connected.

Figure 9A:
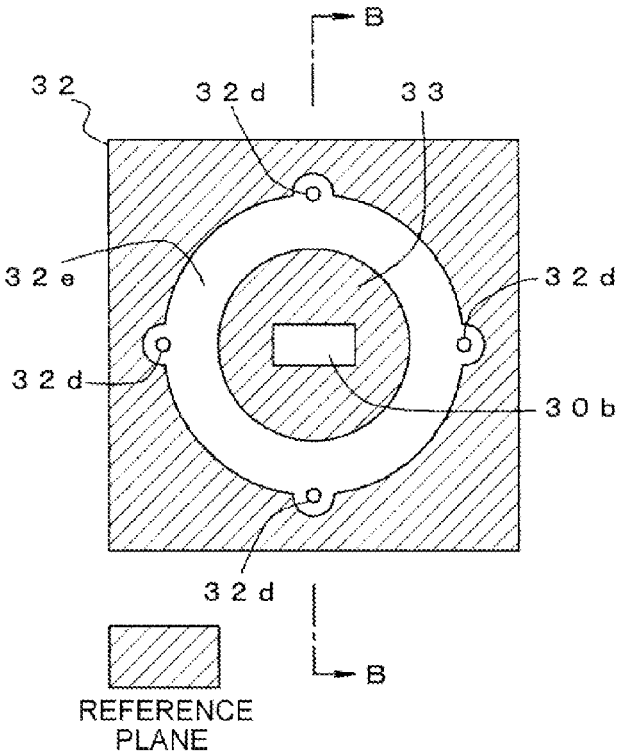
FIGS. 9A and 9B are diagrams illustrating another example of the structure of an end surface of a second transmission line forming body.
Figure 9B:
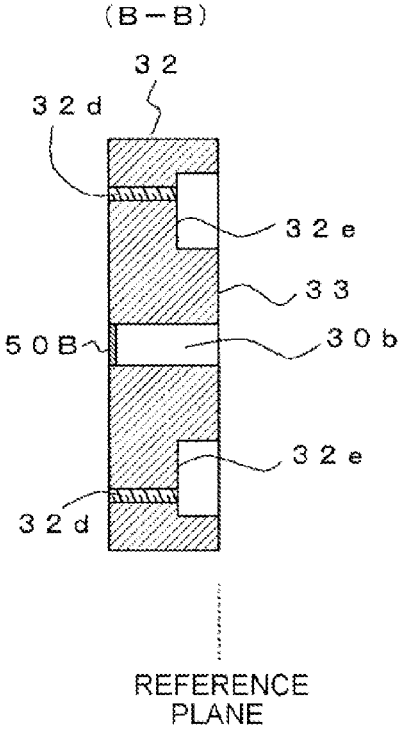

In the above-described embodiment, in the end surface 32*b* of the second transmission line forming body 32, the depressed portion 32*e* is limited to a possible narrow region which surrounds the position where screw hole 32*d* is formed and the other region including central region 33 has a height equal to the reference plane. However, the depressed portion may have any size or shape as far as the height of central region 33 which has the same size as the protruding portion defined by the flange structure based on the predetermined standard is the reference plane and the depressed portion that is depressed to a depth greater than the length of the thread portion of screw 205 used in flange structure from the reference plane is provided in the region which is arranged outside the central region 33 and includes the screw hole forming position defined by flange structure, as described above. For example, as shown in FIGS. 9A and 9B, the range of depressed portion 32*e* may expand to the outer edge of the central region 33.

In the above-described embodiment, the first transmission line forming body 31 of the second waveguide 30 is fixed and supported by the base portion 60 and the second transmission line forming body 32 is screwed to the first transmission line forming body 31 at the predetermined position. However, when the second transmission line forming body 32 is fixed to the first transmission line forming body 31, the second transmission line forming body 32 may be screwed to the base portion 60 at a position that is further away from the transmission line 30*b* than a screwing position for connecting the external circuit. In this case, it is possible to further suppress deformation when the external circuit is connected.

Figure 10:
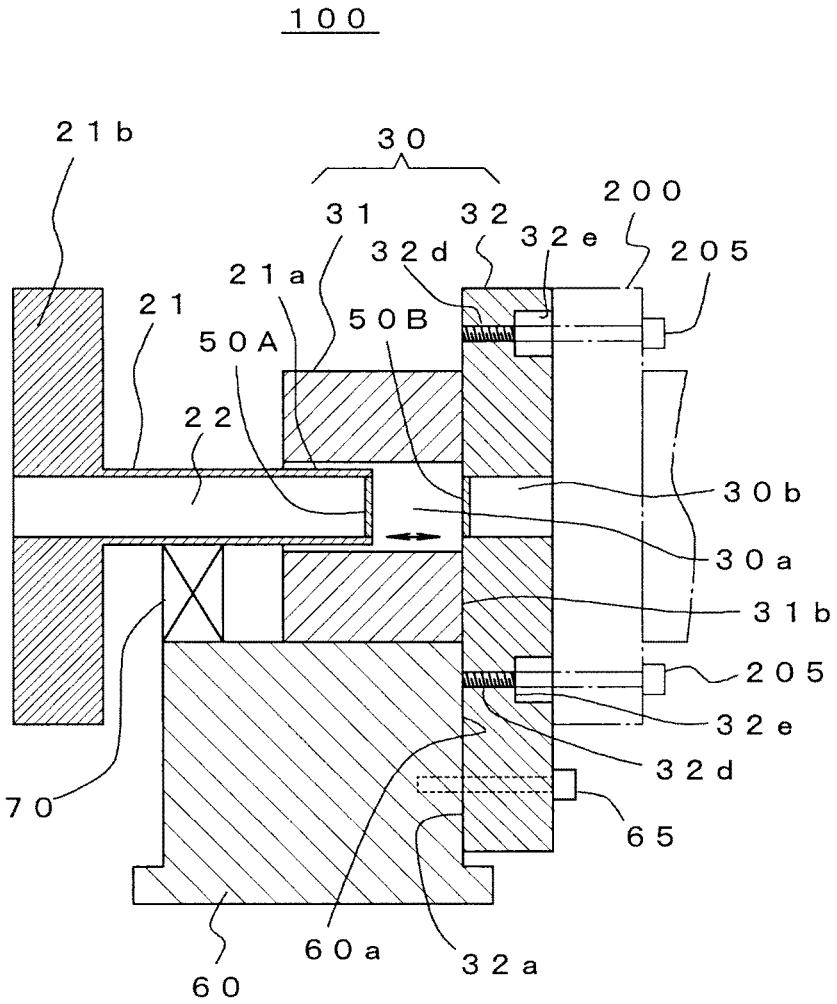
FIG. 10 is a diagram illustrating an example of a structure in which the second transmission line forming body is screwed to a base portion.
Figure 11:
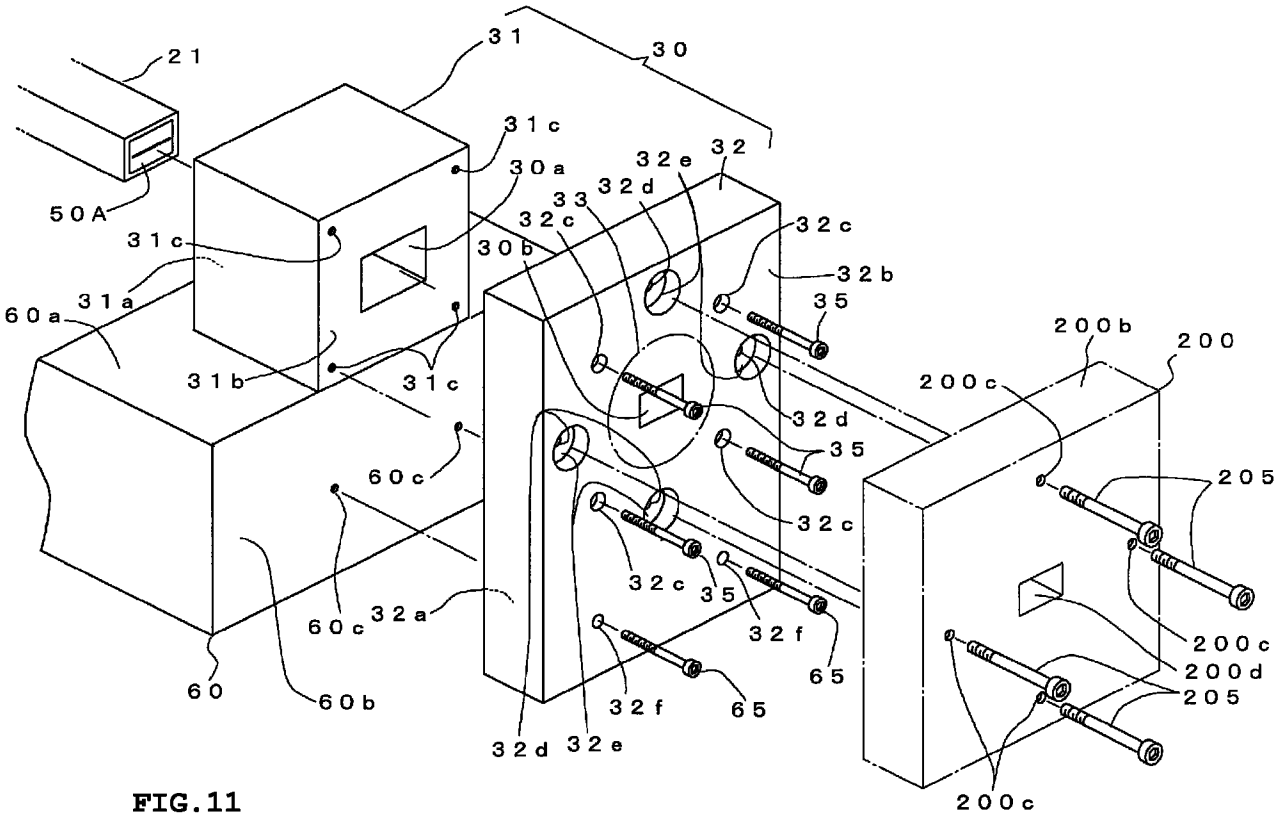
FIG. 11 is an exploded perspective view illustrating the structure shown in FIG. 10.
Figure 12A:
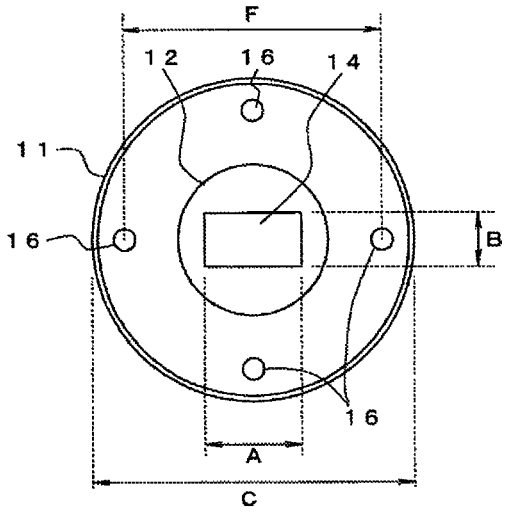
FIGS. 12A and 12B are diagrams illustrating a flange structure based on a MIL standard.
Figure 12B:
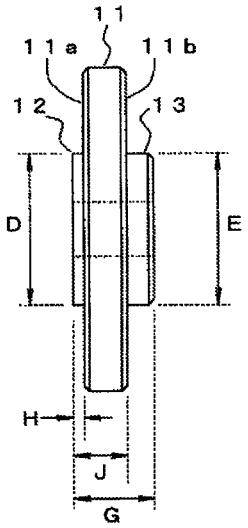
Figure 13:
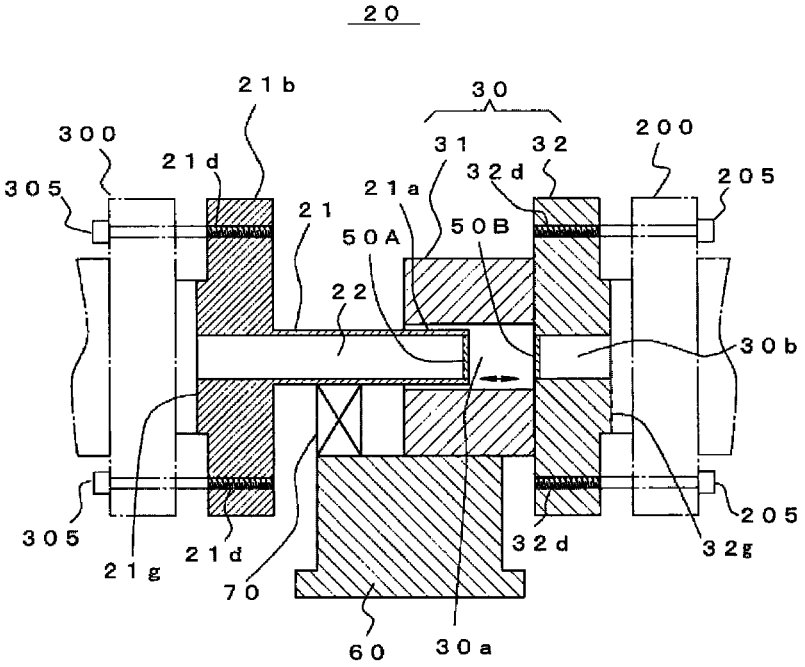
FIG. 13 PRIOR ART
FIG. 13 is a diagram of the related art illustrating an example of a structure when external circuits are connected to a first waveguide and a second waveguide on the basis of a flange structure based on a predetermined standard.
Figure 14:
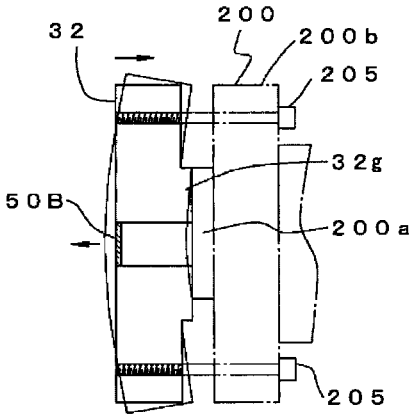
FIG. 14 PRIOR ART
Figure 15:
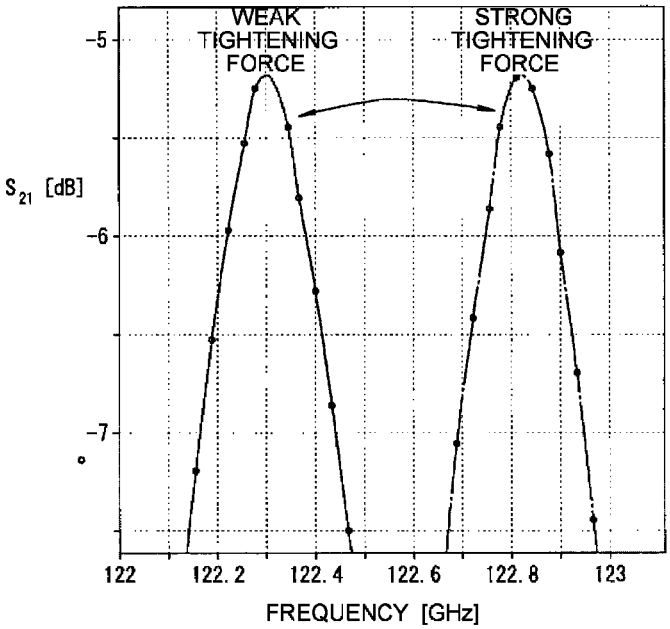
FIG. 15 PRIOR ART
FIG. 15 is a diagram of the related art illustrating a change in a resonance frequency due to the strength of a screw tightening force.
Figure 16:
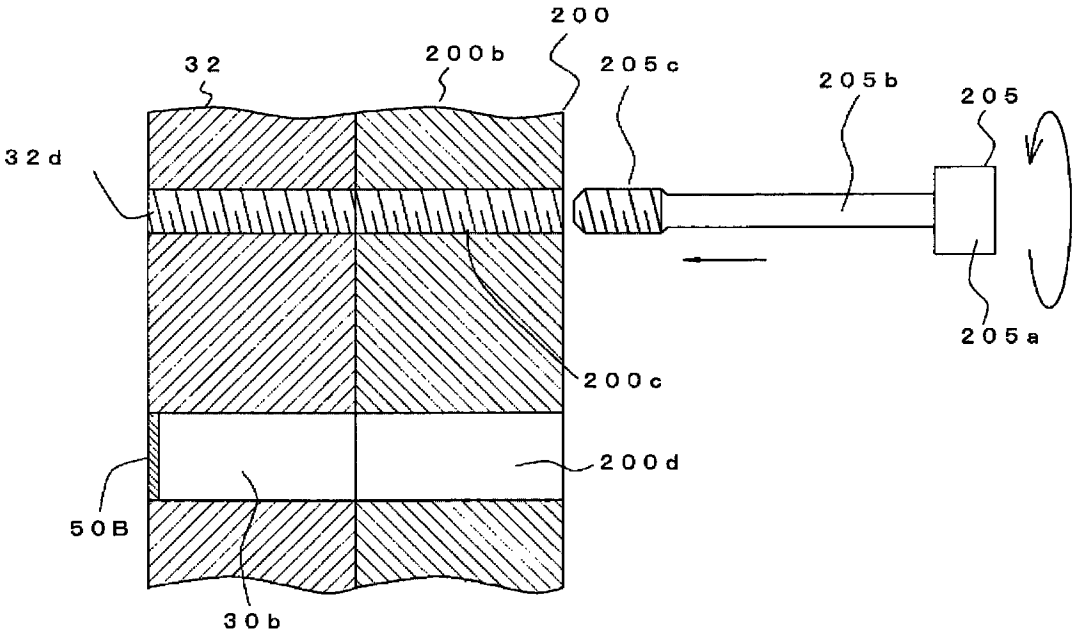
FIG.16 PRIOR ART
FIG. 16 is a diagram of the related art illustrating a structure and an operation when an external circuit with a flat flange structure is screwed.
Figure 17:
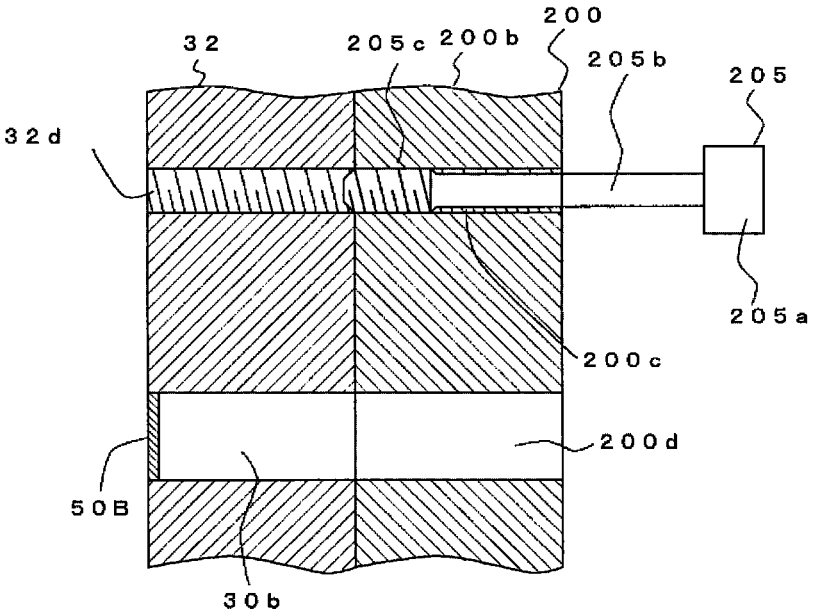
FIG. 17 PRIOR ART
FIG. 17 is a diagram of the related art illustrating the structure and the operation when the external circuit with the flat flange structure is screwed.

FIGS. 10 and 11 show an example of the structure of the above-mentioned modification. The first transmission line forming body 31 is fixed such that an end surface 31*b* thereof is continuously flush with an end surface 60*b* of the base portion 60. The periphery of the transmission line 30*b* of the second transmission line forming body 32 having an extended lower part is fixed to the end surface 31*b* of the first transmission line forming body 31 by screws 35, similarly to the above. Screws 65 pass through holes (without a thread groove) 32*f* which are provided in the extended lower part and are then inserted into screw holes (with a thread groove) 60*c* provided in the end surface 60*b* of the base portion 60. However, the hole 32*f* has a tolerance with respect to the diameter of the screw 65, considering the slight positional deviation of the second transmission line forming body 32.

As such, the second transmission line forming body 32 is screwed to the base portion 60 at the position that is further away from the transmission line 30*b* than a standard external circuit screwing position. Therefore, it is possible to further suppress deformation when the external circuit is connected and the concern that the relationship between the resonance frequency and the position of a waveguide in a single filter (the gap between the radio wave half mirrors) will vary depending on the connection of the external circuit is further reduced.

DESCRIPTION OF REFERENCE NUMERALS AND SIGNS

21: FIRST WAVEGUIDE
22: TRANSMISSION LINE
30: SECOND WAVEGUIDE
30*a*: FIRST TRANSMISSION LINE
30*b*: SECOND TRANSMISSION LINE
31: FIRST TRANSMISSION LINE FORMING BODY
32: SECOND TRANSMISSION LINE FORMING BODY
32*e*: DEPRESSED PORTION
33: CENTRAL REGION
50A, 50B: RADIO WAVE HALF MIRROR
60: BASE PORTION
70: MOVING DEVICE
200: EXTERNAL CIRCUIT

What is claimed is:

1. A millimeter waveband filter comprising:

a first waveguide including a transmission line with a size that is capable of transmitting electromagnetic waves in a predetermined frequency range of a millimeter-wave band in a TE10 mode;

a second waveguide that includes a first transmission line which has a size that is greater than an outside size of the first waveguide and is capable of transmitting the electromagnetic waves in the predetermined frequency range in the TE10 mode and into which one end of the first waveguide is inserted, with a gap between the outside of the first waveguide and the first transmission line, and a second transmission line which has a size less than that of the first transmission line and is formed such that the first transmission line and the second transmission line are concentrically continuous;

a pair of radio wave half mirrors which transmit some of the electromagnetic waves in the predetermined frequency range and reflect some of the electromagnetic waves, one of the pair of radio wave half mirrors being fixed to the transmission line at the one end of the first waveguide, the other radio wave half mirror being fixed to a boundary between the first transmission line and the second transmission line of the second waveguide; and a moving device that moves the first waveguide in a length direction of the transmission line such that a gap between the pair of radio wave half mirrors is changed, thereby selectively transmitting an electromagnetic wave with a resonance frequency which is determined by the gap between the pair of radio wave half mirrors among the electromagnetic waves in the predetermined frequency range, wherein the second waveguide further includes:

a first transmission line forming body in which a rectangular hole forming the first transmission line is formed in a plate portion with a predetermined thickness to a thickness direction so as to pass through the plate portion; and a second transmission line forming body in which a rectangular hole forming the second transmission line is formed in a plate portion with a predetermined thickness in a thickness direction so as to pass through the plate portion, the first transmission line forming body and the second transmission line forming body are formed so as to be connected to and separated from each other, with the plate portions overlapping each other such that the rectangular holes are concentrically continuous, a central region that includes an opening of the second transmission line, and a depressed portion, are provided in one surface of the second transmission line forming body which is opposite to the other surface connected to the first transmission line forming body, a reference plane is at a height of the central region, and the depressed portion is depressed from the reference plane and is provided in a region which is outside the central region and includes screw hole forming positions, screw holes, into which screws for fixing an external circuit to be connected to the second transmission line forming body are inserted, are provided at the screw hole forming positions in the depressed portion, the depressed portion has a depth greater than the length of a thread portion of the screw, and a height of a region that is excluding the depressed portion and is further away from the central region than the screw hole forming positions is equal to the height of the reference plane.

2. The millimeter waveband filter according to claim 1, wherein the first transmission line forming body is fixed to a base portion, and the second transmission line forming body is fixed to the first transmission line forming body at a predetermined position and is screwed to the base portion at a position that is further away from the opening of the second transmission line than the screw hole forming positions.

3. The millimeter waveband filter according to claim 1, wherein the central region has the same size as a protruding portion that is defined by a flange structure based on a predetermined standard depending on the size of the second transmission line, the screw hole forming positions are defined by the flange structure, and the length of the thread portion is defined by the flange structure.

4. The millimeter waveband filter according to claim 2, wherein the central region has the same size as a protruding portion that is defined by a flange structure based on a predetermined standard depending on the size of the second transmission line, the screw hole forming positions are defined by the flange structure, and the length of the thread portion is defined by the flange structure.

5. The millimeter waveband filter according to claim 3, wherein the second transmission line has a rectangular shape in a cross-sectional view, a number of the screw holes is four, the four screw holes are defined by the flange structure of the second waveguide, and the four screw holes are formed at positions that are a predetermined distance away from the center of the second transmission line and are arranged on a center line extending in a width direction of the transmission line and a center line extending in a height direction of the transmission line.

6. The millimeter waveband filter according to claim 4, wherein the second transmission line has a rectangular shape in a cross-sectional view, a number of the screw holes is four, the four screw holes are defined by the flange structure of the second waveguide, and the four screw holes are formed at positions that are a predetermined distance away from the center of the second transmission line and are sited on a center line extending to a width direction of the transmission line and on a center line extending to a height direction of the transmission line.

7. The millimeter waveband filter according to claim 5, wherein the length of a shaft portion of the screws are greater than the thickness of a flange portion of the external circuit, the depth of the depressed portion is greater than the length of the thread portion having a thread groove formed therein in the screws, and the sum of the depth of the depressed portion and the thickness of the flange portion of the external circuit is less than the sum of the lengths of the shaft portion and the thread portion of the screw.

8. The millimeter waveband filter according to claim 6, wherein the length of a shaft portion of the screws are greater than the thickness of a flange portion of the external circuit, the depth of the depressed portion is greater than the length of the thread portion having a thread groove formed therein in the screws, and the sum of the depth of the depressed portion and the thickness of the flange portion of the external circuit is less than the sum of the lengths of the shaft portion and the thread portion of the screw.

9. The millimeter waveband filter according to claim 7, wherein the predetermined standard is a MIL standard.

10. The millimeter waveband filter according to claim 8, wherein the predetermined standard is a MIL standard.

* * * * *